United States Patent [19]

Shofner et al.

[11] 4,279,090

[45] Jul. 21, 1981

[54] ENERGY RELEASING NOVELTIES

[76] Inventors: Manley R. Shofner; Lenora M. Huett, both of P.O. Box 1041, Pioneer, Calif. 95666

[21] Appl. No.: 35,327

[22] Filed: May 2, 1979

[51] Int. Cl.[3] ..... G09F 7/22; A63H 1/32

[52] U.S. Cl. ..... 40/617; 46/47; 46/53; 428/7; 428/542; 428/332

[58] Field of Search ..... 428/7, 8, 542, 332; 46/53, 56, 47; 40/617

[56] References Cited

U.S. PATENT DOCUMENTS

| | | | |
|---|---|---|---|
| 3,564,759 | 2/1971 | Buttermore | 40/617 |
| 4,149,632 | 4/1979 | Tunstull et al. | 40/617 |

*Primary Examiner*—Paul J. Thibodeau

*Attorney, Agent, or Firm*—Arlington C. White

[57] ABSTRACT

The basis here is the pyramid shape used in a spiral form. Pyramid shapes are placed in a spiral form in such a manner that they transmit an ascending amount of energy one to the other until this energy culminates in a base pyramid shape.

2 Claims, 6 Drawing Figures

FIGURE 1-A
SCALE 1/2" = 1"

FIGURE 1-B
SCALE 1/2" = 1"

FIGURE 1-C
SCALE 1/2" = 1"

FIGURE 1-E
SCALE 1/2" = 1"

FIGURE 1-D
SCALE 7/16" = 1"

VERTICAL RELATIONSHIP

SCALE AS MARKED

SCALE 7/16" = ONE INCH

P = PYRAMID SHAPE

ENERGY RELEASING NOVELTIES

SUMMARY

The inventors have utilized the principle as given in "Abstract of the Disclosure" in the form of a mobile. A circle of cardboard is used as a top support for the pyramid shapes and a number of pyramid shapes are suspended from the edge of this cardboard circle, placed equidistant from each other, and suspended by cotton thread. A base pyramid shape is suspended from the center of the supporting cardboard circle.

Care is taken in the spatial relationships of these pyramid shapes as follows: the base, or bottom edge of each pyramid shape in the spiral, is level with the top or peak of the next pyramid shape below, and it is found that a horizontal separating distance roughly corresponding with the length of one side of the pyramid shape used gives the desired result. The top or peak of each suspended pyramid shape should be physically disturbed or deformed as little as possible by the suspending medium.

Care is also taken to maintain the supporting cardboard circle in a horizontally level position, as any variation from this would result in a distortion of the spiral form. As used in the unit we have constructed, the resulting spiral form should not overlap itself.

BRIEF DESCRIPTION OF DRAWINGS

The two pages of drawings should be used as follows:

FIG. 1-A, a top view of the cardboard support, also shows the diameter of the spiral formed by the pyramid shapes.

FIG. 1-B is a side view of FIG. 1-A.

FIG. 1-C is a top and a side view of one of the pyramid shapes.

FIG. 1-D is a view showing the basic base to peak level relationships of the pyramid shapes utilized in the spiral form.

FIG. 1-E is a side view of another of the pyramid shapes.

DETAILED DESCRIPTION

Since the principle here is "the pyramid shape used in a spiral form", more than one mode of carrying out and using this may be contemplated. The easiest mode for the inventors and the one chosen, a mobile, is here described. We chose a seven inch diameter size.

Materials required: (use lightest materials for least mass.)

- Cardboard—1 piece, round, 7" diameter; thickness sufficient to maintain rigidity—$\frac{1}{8}$"—is sufficient for this size unit.
- Pyramid shapes—8 used in our mobile. We used cardboard such as common file cards, the thinner the better—3"×5" works well—in their construction.
- Thread—1 spool cotton—size "50".
- Scotch tape—one roll $\frac{1}{2}$" wide.

CONSTRUCTION OF UNIT

Preparation:

Cut one round piece of cardboard seven inches in diameter and mark at equal distances around the edge seven points. These will be at 51.42857 degrees. Also mark the center, punching a hole at the center large enough to draw a thread up through (with a needle—it is the easiest way). Next, about one to two inches in from the outer edge, punch two holes approximately one half inch apart at three equidistant points.

Figure 1:
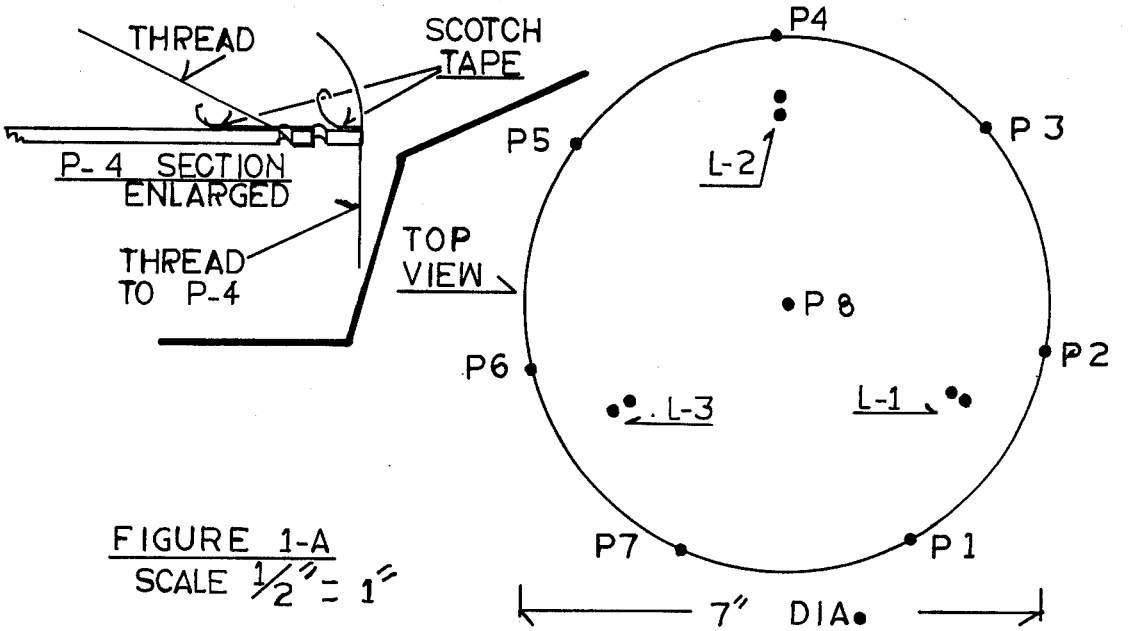
FIG. 1-A, FIG. 1-C and FIG. 1-E show dimensions of the pyramid shapes used and their placement around the circular cardboard support.
Figure 1:
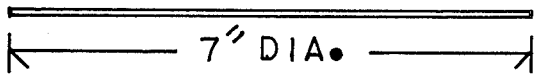
Figure 1:
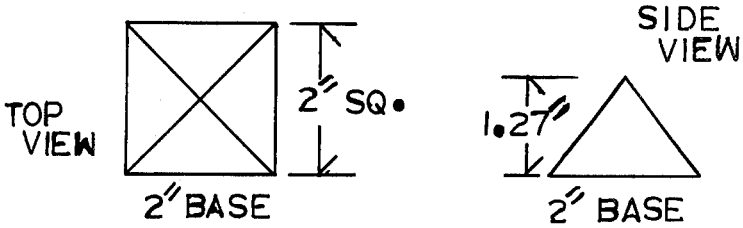
Figure 1:
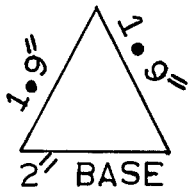
Figure 1:
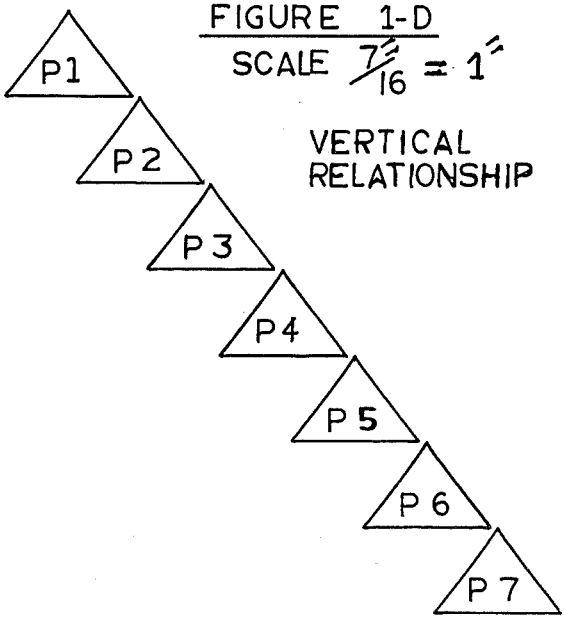

FIG. 1-A shows such a round piece of cardboard as described. If desired, a cut at the seven points around the edge may be made with a sharp instrument such as a knife, about half way through the cardboard.

Next, prepare thirty-two pieces of cardboard in the shape of a triangle as in FIG. 1-E. (Do not scale drawing—use dimensions given thereon.) Use four of these for each pyramid, placing the individual pieces side by side on a flat surface, the tops together and use scotch tape to hold them together, carefully trimming the tape with a razor blade or sharp knife. It is best to work with two pieces at a time, taping them together, then add a third, and then a fourth. At this point, fold the first and fourth pieces in over the second and third. The outer edges of the first and fourth pieces will then come together for taping and trimming.

We then cut a piece out of the same material, one and seven eighths inches square, (not shown on the drawings) which was placed in the bottom of the pyramid just constructed, and put a small bead of glue around its edges—this was done to maintain the square shape of the pyramid base. A hole may be placed in this square piece if desired to decrease mass, as large as desired so long as the pyramid base remains square.

When eight pyramids are made thusly, (see FIG. 1-C) tie a knot in one end of a piece of thread approximately ten inches long (after knotting) and, using a needle, draw this thread up through the peak of one pyramid from its base, pulling the thread gently, to place the knot at its end snugly in the peak. Prepare six other pyramids in the same way, but adding approximately two inches of length to the thread for each succeeding pyramid. The eighth pyramid requires a thread length approximately 26 to 30 inches.

Leveling and Suspending the Unit:

In order to maintain the pyramid shapes (used) in a spiral form, the round cardboard support (FIG. 1-A) must be level and remain level when the completed unit is suspended and operating. The leveling may be done as a first or last step in the assembly. As a first step: use a length of thread about 12" to 18" in length.

Using a needle, pull one end down through one of the holes (marked L-1 in FIG. 1-A) and up through other hole nearest it and tie it off there. Do the same thing at points L-2 and at L-3. In our units we use a small round "bubble" level about one inch in diameter, placing it in the center of the cardboard. Taking the free ends of the three pieces of thread together, gently lift the cardboard and draw the thread individually to achieve a level cardboard position. Tie the threads together.

For the final suspension of the mobile, use a thread long enough for the result desired by the individual user, tying one end to the top position of the "three-thread" step described above and the other end to any convenient wall bracket, ceiling hook, or other device.

An alternate suspending and leveling method would be to place a cone with a 7" diameter base over the cardboard circle and gluing it in place, suspend the complete unit by a thread from the peak of the cone. If this method is used, it would be a final step of assembly.

Assembly:

Using any convenient flat surface such as a workbench or table, place the round cardboard on it so that one of the "P" points (see FIG. 1-A) extends over the edge about two or three inches. A weight placed on the cardboard helps greatly from here throughout the rest of the assembly. Place FIG. 1-A and FIG. 2 close by for reference.

Step One: Now take the pyramid shape with the shortest thread as previously prepared and place the free end of the thread in the knife cut at the edge of the cardboard. Pull the thread gently upward until there is at least five inches of thread exposed between the cardboard edge and the top or peak of the "dangling" pyramid shape, affixing the thread permanently with a small piece of scotch tape to the top surface of the cardboard circle, (see FIG. 1-A, "P-4 section enlarged"). This will be P-1 in FIG. 2.

Step Two: Rotate the cardboard so that points P-1 and P-2 are both extended over the edge of the work bench or table, with P-1 hanging freely. Take the pyramid shape with the shortest remaining thread length and, using the method described in the last step, draw the thread upward through point P-2 in FIG. 1-A until the peak of the dangling pyramid shape is level with the base of pyramid shape P-1, and fasten the thread with scotch tape as in the last step.

Figure 2:
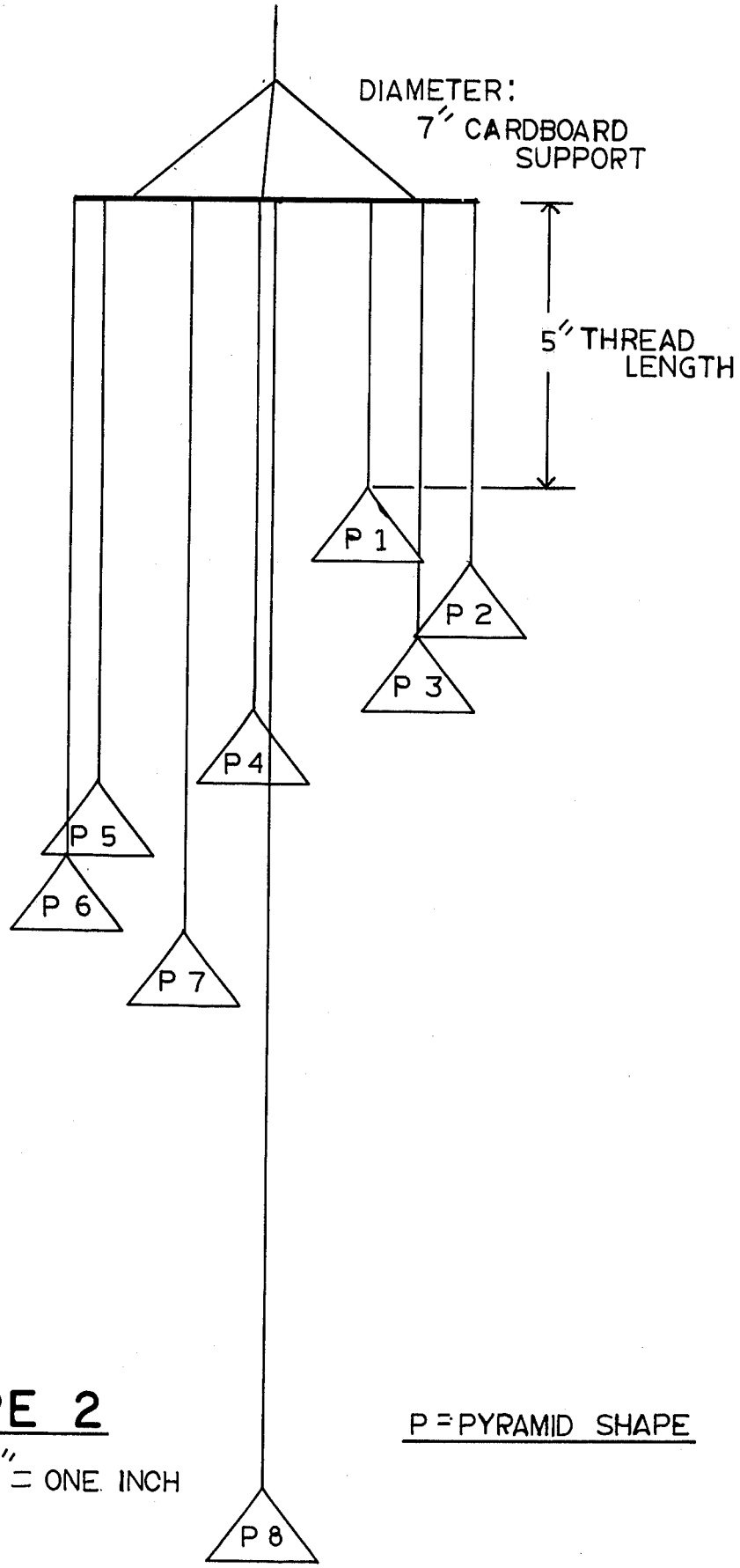
FIG. 2 shows the completed unit and the spatial relationships of the various component parts, the square pyramid shapes represented by triangles.

Repeat steps one and two until pyramid shapes P-1 through P-7 have been assembled onto the round cardboard circle, carefully maintaining level base to peak relationships, as in FIG. 1-D and FIG. 2. Pyramid shape P-8 thread can now be drawn upward through the hole marked "P-8" in FIG. 1-A, until a thread length of 22" is exposed between the top or peak of P-8 to the bottom of the cardboard circle, and fastened with scotch tape. All excess thread lengths may now be clipped off and disposed of, as with scissors. The thread length so exposed is equal to the circumference of the supporting cardboard circle used.

The unit is now completely assembled and ready for use unless the leveling step has been delayed until this point, in which case perform this step as described in paragraph headed "Leveling and Suspending the Unit".

We claim:

1. A new article of manufacture comprising a mobile consisting of a circular support, a plurality of pyramid shapes depending at different levels and at equally spaced apart points from the circumference of said circular support in spiral arrangement and wherein the bottom edge of each pyramid shape in said spiral arrangement is level with the peak of the succeeding pyramid shape of said plurality of pyramid shapes and wherein said circular support is maintained in a horizontally level position, and a base pyramid shape depending from the center of said circular support below said plurality of pyramid shapes for receiving energy released therefrom.

2. A new article of manufacture as set forth in claim 1 wherein the diameter of said circular support is 7 inches and wherein the number of said plurality of pyramid shapes is 7 and wherein the spaces between the points of suspension thereof from the circumference of said circular support are uniform to insure a spiral arrangement of said plurality of pyramid shapes depending from said circular support.

* * * * *